US008684614B2

(12) United States Patent
Chawla et al.

(10) Patent No.: US 8,684,614 B2
(45) Date of Patent: Apr. 1, 2014

(54) DETERGENT DISPENSING AND PRE-TREATMENT CAP

(75) Inventors: Nalini Chawla, Mason, OH (US); Karla Mishell Sanchez, Cincinnati, OH (US); Lauren Eisenmenger, Cincinnati, OH (US); Tom Collins, Mason, OH (US); John Charles Wilkins, Bellevue, KY (US)

(73) Assignee: The Proctor & Gamble Company, Cincinnati, OH (US)

( * ) Notice: Subject to any disclaimer, the term of this patent is extended or adjusted under 35 U.S.C. 154(b) by 428 days.

(21) Appl. No.: 13/013,858

(22) Filed: Jan. 26, 2011

(65) Prior Publication Data

US 2011/0179585 A1 Jul. 28, 2011

(30) Foreign Application Priority Data

Jan. 26, 2010 (CA) ..... 2691258

(51) Int. Cl.
*A46B 11/00* (2006.01)

(52) U.S. Cl.
USPC ..... 401/126; 401/123; 215/390

(58) Field of Classification Search
USPC ..... 401/126, 129, 130, 118, 123; 222/502, 222/519, 522, 528, 531, 537; 215/228, 386, 215/390, 391; 220/212
See application file for complete search history.

(56) References Cited

U.S. PATENT DOCUMENTS

| | | | | |
|---|---|---|---|---|
| 3,090,067 | A | | 5/1963 | Weiby et al. |
| 3,107,388 | A | | 10/1963 | Groves |
| 4,741,459 | A | | 5/1988 | Silvenis et al. |
| 4,767,034 | A | | 8/1988 | Cramer |
| 5,181,630 | A | | 1/1993 | McNally |
| 5,228,596 | A | * | 7/1993 | McNally ..... 222/109 |
| 5,251,788 | A | | 10/1993 | Moore |
| 5,355,541 | A | | 10/1994 | Rutter et al. |
| 5,388,298 | A | | 2/1995 | Rutter et al. |
| 5,459,209 | A | | 10/1995 | Jablon |
| 5,549,209 | A | | 8/1996 | Weissman et al. |
| D382,482 | S | | 8/1997 | Lathrop et al. |
| 6,353,954 | B1 | | 3/2002 | Dunsbergen et al. |
| 6,739,781 | B2 | | 5/2004 | Maloney et al. |
| 6,874,190 | B2 | | 4/2005 | Deflander et al. |
| 7,425,102 | B1 | | 9/2008 | Velliquette |
| D689,364 | S | | 9/2013 | Sanders |
| 2003/0198502 | A1 | | 10/2003 | Maloney et al. |

(Continued)

FOREIGN PATENT DOCUMENTS

| | | |
|---|---|---|
| DE | 200 04 275 U1 | 8/2000 |
| GB | 2 168 931 | 7/1986 |

(Continued)

OTHER PUBLICATIONS

International Search Report for International Application Serial No. PCT/US2011/022387, mailed May 25, 2011, 9 pages.

(Continued)

*Primary Examiner* — David Walczak
(74) *Attorney, Agent, or Firm* — Gary J. Foose

(57) ABSTRACT

A detergent dispensing cap for pre-treating a stained fabric. The cap can have a pour volume sized and dimensioned to provide for a unit dose of the detergent composition. A portion of the cap can be provided with surface irregularities for scrubbing a stain.

13 Claims, 10 Drawing Sheets

(56) References Cited

U.S. PATENT DOCUMENTS

| | | | |
|---|---|---|---|
| 2009/0014465 | A1 | 1/2009 | De Wree et al. |
| 2009/0045224 | A1 | 2/2009 | Faaborg et al. |
| 2011/0162151 | A1 | 7/2011 | Chawla et al. |
| 2011/0179586 | A1 | 7/2011 | Chawla et al. |
| 2011/0179587 | A1 | 7/2011 | Wilkins et al. |
| 2011/0311296 | A1 | 12/2011 | Chawla et al. |
| 2012/0297552 | A1 | 11/2012 | Davis et al. |
| 2012/0298543 | A1 | 11/2012 | Davis et al. |

FOREIGN PATENT DOCUMENTS

| | | | |
|---|---|---|---|
| GB | 2 349 649 | | 11/2000 |
| JP | 11-244770 | A | 9/1999 |
| WO | WO 98/16148 | A1 | 4/1998 |
| WO | WO 98/16438 | A1 | 4/1998 |
| WO | WO 00/20676 | A1 | 4/2000 |
| WO | WO 01/23295 | A2 | 4/2001 |
| WO | WO 02/16686 | A1 | 2/2002 |
| WO | WO 2004/112538 | A1 | 12/2004 |
| WO | WO 2008/135953 | A1 | 11/2008 |
| WO | WO 2010/012552 | A1 | 2/2010 |

OTHER PUBLICATIONS

Photographs of a dosing ball sold with a Henkel Persil Gold 1.5L bottle that was purchased in Sep. 2009.

Notice of Allowance for U.S. Appl. No. 12/820,538, mailed Jul. 19, 2013, 10 pages.

Non-Final Office Action for U.S. Appl. No. 12/820,538, mailed Mar. 15, 2013, 10 pages.

* cited by examiner

DETERGENT DISPENSING AND PRE-TREATMENT CAP

FIELD OF THE INVENTION

A detergent dispensing cap for pre-treating a stained fabric.

BACKGROUND OF THE INVENTION

Treating stained garments continues to be an aspect of laundering that could be improved. There are a variety of commercially available approaches for treating stains. In one approach the consumer merely washes with a detergent touted as having the ability to treat stains. Such an approach tends to work satisfactorily if the stains are light and not greasy. If the stains are heavy, the stains might not be removed because the chemical ingredients of detergent are diluted in the wash and are not concentrated at the stain. This can leave the consumer dissatisfied when at the end of the wash cycle she sees that the stains are still visible. The prospects for successful stain treatment after washing are limited, particularly if the failure is not detected until after drying the stained garment.

Some liquid detergents can be effective when used to pre-treat stains by locally applying a small quantity of detergent to the stained portion of the garment. Many consumers do not use liquid detergents to pre-treat stains because they are unaware that such a practice can be successfully used to treat stains and the practice can be messy and cumbersome. Thus, many consumers use specialized stain treatment aids.

Stain treatment aids may be applied to the stain in liquid form by spraying or squirting the stain treatment aid directly on the stain or using a wipe impregnated with a stain treatment aid to scrub a stain. Some stain treatment aids include a motorized brush or scrubbing implement to assist with treating the stain in the fabric.

The typical consumer experience with presently available approaches for treating stains in the home is cumbersome. The consumer first has to remember to purchase the detergent, the stain treatment aid, and any accompanying devices, or replacement devices. The consumer then stores all of these items near the washing machine. Then, the consumer must remember to identify and treat stains prior to the stained garment being placed in the washing machine. The consumer must then locate the stain treatment aid and manipulate the packaging or device to apply the stain treatment aid to the stain. The consumer then stores the stain treatment aid, frequently in an unsightly gathering of laundry products nearby the washing machine. Consumers often rinse their hands after this step to avoid the greasy feeling of common stain treatment aids and to avoid transferring the stain treatment aid to other surfaces, washing machine controls, and detergent packaging. The consumer then opens the laundry detergent, measures out the appropriate dose, and delivers the dose of detergent to the washing machine. Finally the consumer stores the laundry detergent. This multistep process is a less than desirable consumer experience, particularly given all the other demands on the consumer's time and mental focus.

With these limitations in mind, there is a continuing unaddressed need for a device and approach for treating stains that intuitively suggests to the consumer to treat stains properly, is intuitive for the consumer to remember to apply, is simple to apply, and performs satisfactorily.

SUMMARY OF THE INVENTION

A cap for dispensing a detergent composition. The cap can comprise: a base having a base interior and a base exterior opposing the base interior, the base interior having a periphery. The cap can comprise a vessel wall having an interior surface and an exterior surface opposing the interior surface, the vessel wall extending from the periphery to a rim. The interior surface and the base define a pour volume. The cap can be sealingly engaged to a container containing a detergent composition by a connector disposed on the cap and a corresponding receiver disposed on an opening of the container. The cap can further comprise a plurality of first surface irregularities at a location selected from the group consisting of on the rim, on the exterior surface between the connector disposed on the cap and the rim, and combinations thereof. The pour volume can be sized and dimensioned to provide for a unit dose of the detergent composition.

A method of pre-treating a clothing article having a stained portion comprising the steps of: removing a cap from a container containing a detergent composition; pouring a volume of the detergent composition from the container into the cap; applying at least a portion of the volume to a stained portion of the stained clothing article; scrubbing the stained portion with a portion of the cap; and reengaging the cap with said container containing the detergent composition.

DETAILED DESCRIPTION OF THE INVENTION

Figure 1:
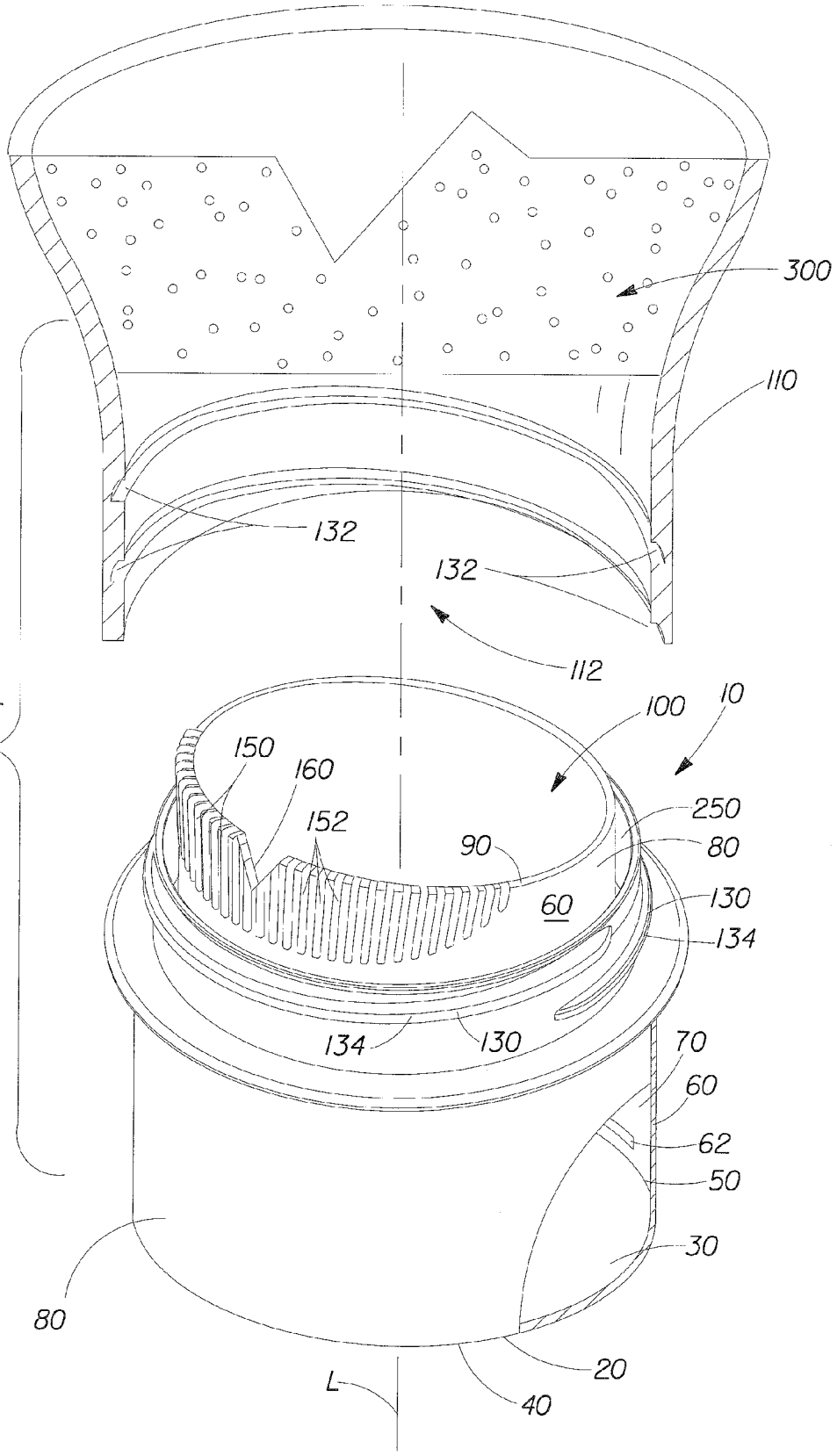
FIG. 1 is a schematic of a cap having first surface irregularities.

FIG. 1 illustrates an embodiment of a cap 10 for dispensing a detergent composition 300 that can be used to pre-treat stains. The cap 10 comprises a base 20. The base 20 has a base interior 30 and a base exterior 40 opposing the base interior 30. The base interior 30 has a periphery 50. The base 20 can be a single layer of material, such as high density polyethylene, a multilayered material, a hollow member, or any other such structure or material having sufficient structural integrity to be used in a cap 10 for a container 110 of laundry detergent composition 300. The detergent composition 300 can comprise a surfactant. The base exterior 40 can provide a surface arrangement that can be stably set upon another surface that is substantially flat as measured on a scale of centimeters, such as a table or a flat portion of a washing machine or dryer. Such surface arrangement can be a generally flat surface or contoured surface arrangement. When the base 20 is set on a flat surface, detergent composition 300 from a container 110 can be poured into the pour volume 100 of the cap 10 and the cap 10 will not easily tip over as detergent composition 300 is poured into the pour volume 100.

A vessel wall 60 extends from the periphery 50 to a rim 90. The vessel wall 60 extends about the longitudinal axis L of the cap. The vessel wall 60 has an interior surface 70 and an exterior surface 80 opposing the interior surface 70. The vessel wall 60 can be a single layer of material, such as high density polyethylene, a multilayered material, a hollow member, or any other such structure or material having sufficient structural integrity to be used as a cap 10 for a container of laundry detergent composition 300. The interior surface 70 can be provided with one or more indicia 62 that mark the desired level of detergent composition 300 that provides for an appropriate unit dose of detergent composition 300. The indicia 62 can be an etch, a depression, a raised portion, printing, or any other structure that is observable by the consumer. The vessel wall 60 can be a cylindrical segment.

The interior surface 70 and base interior 30 together define a pour volume 100, the base interior 30 forming a closed end of the pour volume 100. The pour volume 100 can be sized and dimensioned to provide for a unit dose of a detergent composition 300. The detergent composition 300 can be a liquid detergent composition 300 such as any of the liquid detergents marketed as TIDE, available from The Procter & Gamble Co., Cincinnati, Ohio, USA. In one embodiment, the interior surface 70 and base interior 30 together form an open ended, or partially open ended, cup with the base interior 30 forming the closed end of the cup. The longitudinal axis L can extend through the open portion of the open end of the cap 10 defined by or partially by the rim 90.

The interior surface 70 of the vessel wall 60 can be defined by a surface of revolution about the longitudinal axis L. In one embodiment, interior surface 70 of the vessel wall 60 can be defined by a portion of the interior surface of a hollow cylinder. Surfaces of revolutions of functions not parallel to the longitudinal axis L and surfaces of revolution of non-linear functions are contemplated. A cap 10 having an interior surface 70 of vessel wall 60 that is a surface of revolution can provide for ease of manufacture of the cap 10 and engaging the cap 10 with the container 110 after filling the container 110 with detergent composition 300 during manufacture and packaging.

The cap 10 can be sealingly engaged to a container 110 containing a detergent composition 300. By sealingly engaged, it is meant that the cap 10 does not leak an unacceptable quantity of detergent composition 300 from the container under stresses to the cap 10 and container 110 that occur during manufacturing, packaging, shipping, handling, storage, and use of the container 110 and detergent composition 300 stored therein. The cap 10 can be sealingly engaged to the container by a connector 130 disposed on the cap 10 and a corresponding receiver 132 disposed on an opening 112 of the container. The connector 130 and corresponding receiver 132 can be a lug and groove combination, the combination being arranged such the lug can be the connector 130 or the receiver 132 and the groove being whichever of the connector 130 and receiver 132 that the lug is not. The connector 130 and receiver 132 can be interlocking correspondingly disposed threads 134 helically disposed on the cap 10 and container 110. That is, the connector 130 can be threads and the receiver 132 can be corresponding threads. The cap 10 can be sealingly engaged to the container by threads 134 helically disposed on the cap 10 and corresponding disposed threads 134 on the opening 112 of the container 110. The cap 10 can be provided with a connector 130 at any suitable location such that the connector 130 can be operatively engaged with the receiver 132 on the container 110. The connector 130 can be disposed on the exterior surface 80 of the vessel wall 60. The connector 130 can be disposed on the interior surface 70 of the vessel wall 60. The cap 10 can be provided with threads 134 in any suitable location such that the threads 134 can be operatively engaged with the container 110. The threads 134 can be disposed on the exterior surface 80 of the vessel wall 60. The threads 134 can be disposed on the interior surface 70 of the vessel wall 60, which can provide for cleaner use of the cap 10. The cap 10 can be releasably attachable to a container 110 by a pressure fitting and detachable there from.

As shown in FIG. 1, the rim 90 can have a weir 160. A weir 160 can provide for more precise delivery of detergent composition 300 to a stain in a fabric by constricting the flow of detergent composition 300 from the cap 10 as a small quantity of detergent composition 300 is applied to the stain. The weir 160 can be any of the common shapes for weirs including a V shape, a semicircular shape, a trapezoidal shape, a multilevel weir having discontinuous function describing the hydraulic radius, or any other such shape that can constrict flow of detergent composition 300.

The cap 10 can comprise a plurality of first surface irregularities 150 at a location selected from the group consisting of on the rim 90, on the exterior surface 80 between the connector 130 and the rim 90, and combinations thereof. For instance, as shown in FIG. 1, the first surface irregularities 150 are illustrated as being on the rim 90 and between the connector 130 and the rim 90. The first surface irregularities 150 can be on the rim 90. The first surface irregularities 150 can be within about 5 mm of the rim 90. The first surface irregularities 150 can be on or within about 5 mm of the rim 90. The first surface irregularities 150 can be on the rim 90 and between the connector 130 disposed on the cap 10 and the rim 90. When the consumer grips the cap 10 to execute pouring, once the pour is made, first surface irregularities 150 located as such are in position to be used to scrub the stain on the fabric with the first surface irregularities 150 without requiring the consumer to reposition the cap in her hand. Further, by placing the first surface irregularities 150 as such, after using the cap 10 to pre-treat and dose the detergent composition 300, the first surface irregularities 150, which might have a small amount of detergent composition 300 remaining thereon, can fit back within the opening 112 of the container 110 to keep any mess inside the container 110.

First surface irregularities 150 can provide a topographically diverse surface that can be rubbed against a stained fabric before or after detergent composition 300 is applied to a stain in a fabric as part of a stain pretreatment process. A topographically diverse surface is a surface that is not smooth. The first surface irregularities 150 when rubbed against a stain on a fabric are thought to help dislodge agglomerations of the stain, deform the fibrous structure of the fabric allowing the detergent composition 300 to more completely penetrate the fibrous structure, and manipulate the fibers of the fabric thereby allowing a greater surface area of the fibers to be wetted with the detergent composition 300. Without being bound by theory, it is believed that dislodging agglomerations of the stain, more completely penetrating the stained fabric with detergent composition 300, and applying detergent composition 300 to a greater surface area of fibers can improve the efficacy of pre-treatment of stains in fabrics.

The plurality of first surface irregularities 150 can have a surface topography that is distinct from the surface topography of portions of the cap 10 adjacent the plurality of first surface irregularities 150. The first surface irregularities 150 can provide for a surface having a plurality of peaks and a plurality of low portions that have an amplitude between adjacent peaks and low portions greater than about 0.1 mm.

The first surface irregularities 150 can provide for a surface having a plurality of peaks and a plurality of low portions that have an amplitude between adjacent peaks and low portions greater than about 0.2 mm. The first surface irregularities 150 can provide for a surface having a plurality of peaks and a plurality of low portions that have an amplitude between adjacent peaks and low portions greater than about 0.5 mm. The first surface irregularities 150 can provide for a surface having a plurality of peaks and a plurality of low portions that have an amplitude between adjacent peaks and low portions greater than about 1 mm. The low portions can be valleys. The plurality of first surface irregularities 150 can define a region that has a surface topography that differs from the surface topography of portions of the cap 10 adjacent the region. The first surface irregularities 150 can be a series of elevated portions having intermittently disposed recessed portions. Recessed portions can be continuous. Elevated portions can be continuous.

The rim 90 can have a weir 160 that is generally aligned with the first surface irregularities 150. In such an embodiment, by generally aligned it is meant that the weir 160 and first surface irregularities 150 are at least within about 0.25π radians of one another about the longitudinal axis L. For instance, as shown in FIG. 1, the weir 160 can be aligned with the first surface irregularities 150. Such an embodiment can be practical because as the user of the cap 10 dispenses the detergent composition 300 over the weir 160 to pre-treat the stain, the consumer will be holding the cap 10 in a position such that the user does not have to reposition her hand to rub the first surface irregularities 150 against the stain. Further, as the consumer observes the pour, she is likely to see the first surface irregularities 150, which will provide her with a visual cue to use the first surface irregularities 150 to scrub the stain.

Further, with the first surface irregularities 150 positioned as such, the user is able to see the first surface irregularities 150 when pouring of a unit dose is initiated. This can be practical as a reminder to the consumer to pre-treat stains if she sees the surface irregularities 150 as she pours the unit dose into the wash basin prior to pre-treating stains.

In one embodiment, the first surface irregularities 150 can comprise a first material and another portion of the cap 10 next to the first material can comprise a second material, wherein the first material and the second material differ from one another. In one embodiment, the first surface irregularities 150 can comprise a first material and another portion of the cap 10 next to the first material can comprise a second material, wherein the first material and the second material differ from one another by a property selected from the group consisting of modulus of elasticity, chemical composition, Shore A hardness, color, and combinations thereof. Shore A Hardness is measured following ASTM D2240 on a material of the same composition as the material being evaluated. A cap 10 comprising first surface irregularities 150 comprised of a first material and another portion of the cap 10 next to the first material comprising a second material can be formed by a two shot injection molding process, with the first material and the second material delivered to the mold in separate shots. In one embodiment, the first material can comprise polypropylene, rubber, neoprene, and/or KRATON. In one embodiment, the portion of the cap 10 next to the first material can be high density polyethylene, polypropylene, polyamide, styro lacrylintrol. The first surface irregularities can be a elastomeric material.

In one embodiment the first material can have a softer feel to the user than the second material, as might be indicated by a lower Shore A hardness or lower modulus of elasticity. The second material can be selected to provide for acceptable overall structural stability of the cap during packaging, storing, shipping, and display of the detergent composition 300 and during use of the cap 10 by the consumer to pre-treat stains. A more readily deformable first material might provide for scrubbing surface that is gentler on the fabric being treated than a scrubbing surface formed of the second material and may not damage the fabric being treated. The first material can have a Shore A hardness between about 20 and about 80. The first material can have a Shore A hardness of between about 40 and about 60. The first material can have a Shore A hardness that is less than about 80% f the Shore A hardness of a portion of the cap 10 next to the first material.

Providing the first material and the second material in two different colors can help the consumer quickly identify what part of the cap 10 is engineered to be used for scrubbing the stain and might be helpful to vision systems that might be used to position the cap 10 during manufacture and/or assembly of the cap and packaging of the detergent composition 300. Providing the first material and the second material to have different chemical composition can yield a cap 10 for which different parts of the cap 10 are designed to provide for different functions, such as one part of the cap being practical and durable for scrubbing and another part of the cap 10 providing for structural stability.

To provide for a potentially cleaner stain pretreatment process, the cap 10 can be provided with a collector 250 that at least partially surrounds the exterior surface 80 of the vessel wall 60, an example of which is shown in FIG. 1. The collector 250 can at least partially circumscribe or circumscribe the exterior surface of the vessel wall 60. The collector 250 can provide for retaining a volume of detergent composition 300 that might drip from the rim 90 or aperture when the detergent composition 300 is dispensed from the cap 10. A portion of the collector 250 can be spaced apart from the exterior surface 80 of the vessel wall 60. The retaining volume defined by the space in the collector 250 and the exterior surface 80 can be disposed along the hydraulic pathway of flow for detergent composition 300 between the rim 90, weir 160, or aperture, and the connector 130 disposed on the cap 10. The collector 250 can help keep the connector 130 free of detergent composition 300 thereby reducing the probability that the consumer may come into physical contact with the detergent composition 300. The collector 250 can be sized and dimensioned to fit in the opening 112 of the container 110 so that detergent composition 300 caught in the collector drips back into the container 110 when the cap 10 is reaffixed to the container 110 after use as a pre-treatment device.

Figure 2:
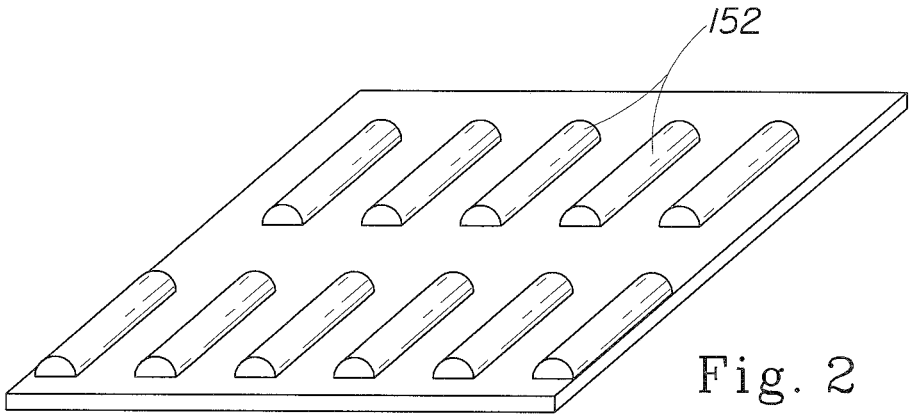
FIG. 2 is a schematic illustrating ribs.

The plurality of first surface irregularities 150 can be structures selected from the group consisting of rings, ribs 152, nubs, bristles, fibers, and combinations thereof. Ribs are a plurality of elongated elevated portions with intermittently disposed elongated recessed portions that are depressed relative to the elevated portions. Ribs 152 can be, for example, a plurality of adjacent grooves etched or molded in substrate and can be a plurality of adjacent ridges. Ribs can be formed in a substrate, for example, by etching a plurality of adjacent grooves in the substrate, by molding the substrate to leave behind a plurality of adjacent grooves, and by molding the substrate to leave behind a plurality of adjacent ridges. An example of a substrate that can form a portion of cap 10 having first surface irregularities 150 and/or second surface irregularities having a plurality of ribs 152 is schematically illustrated in FIG. 2. Ribs 152 can have any desired cross sectional shape including straight edged and rounded. Ribs 152 can be curved along their length. Ribs 152 are thought to provide for a bumpy topography that can effectively scrub and massage the fabric.

Figure 3:
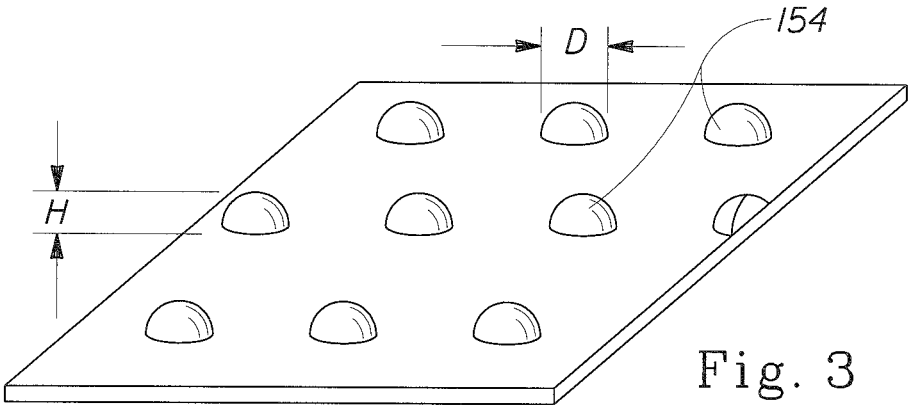
FIG. 3 is a schematic illustrating nubs.

Nubs 154 are generally two-dimensionally symmetric features that are elevated or depressed relative to adjacent portions, an example schematic of which is shown in FIG. 3. Nubs can be, by way of non-limiting examples, elevated portions or depressed portions having a shape of a portion of a hemisphere and elevated portions or depressed portions having a shape of a cylinder having a height H less than half the diameter D. An example of a substrate that can form a portion of cap 10 having first surface irregularities 150 and/or second surface irregularities 155 having a plurality of nubs 154 is schematically illustrated in FIG. 3. Nubs 154 are thought to provide for a bumpy topography that can effectively scrub and massage the fabric.

Figure 4:
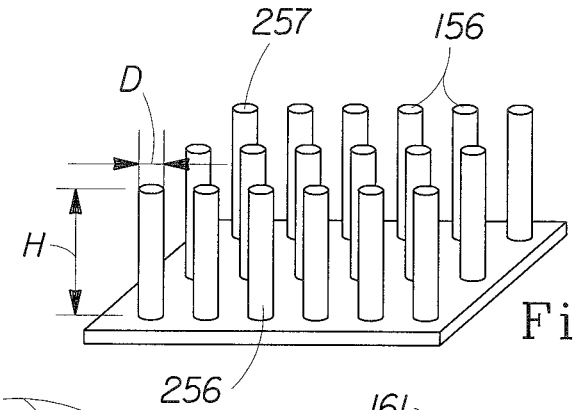
FIG. 4 is a schematic illustrating bristles.

An example of a portion of cap 10 having a plurality of bristles 156 is schematically illustrated in FIG. 4. Bristles 156 are filaments having an aspect ratio of height H to diameter D greater than about 0.5. The diameter D is determined at the base of the bristle which is the location from which the bristle 156 extends from the cap 10. The height H of the bristle 156 is measured orthogonal to the surface from which the base of the bristle 156 extends with the bristle 156 extended orthogonally from the surface from which the base of the bristle 156 extends. Bristles 156 can have a self sustaining shape when extended from the surface from which the base of the bristle 156 extends. For bristles 156 having a non-cylindrical cross section, the diameter D is taken to be the diameter of a cylinder having the same cross-sectional area as the cross-section area of the bristle 156 at the location from which the bristle 156 extends from the cap 10. The filaments can be discrete filaments. Bristles 156 can be filaments having an aspect ratio of height H to diameter D greater than about 1. Bristles 156 can be filaments having an aspect ratio of height H to diameter D greater than about 0.5. Bristles 156 can be generally columnar bristles 156. Bristles 156 are thought to provide for a rough texture/topography that can effectively scrub and massage the fabric. Bristles 156 can be hollow. Bristles 156 can have a fixed end 256 and a free end 257.

Figure 5:
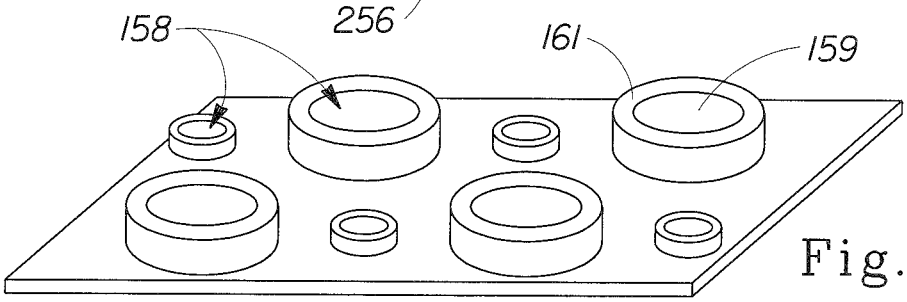
FIG. 5 is a schematic illustrating rings.

Rings 158 are closed shapes in which the central portion 159 of the shape is recessed relative to a peripheral portion 161 of the shape, schematic examples of which are shown n FIG. 5. Rings 158 are thought to be practical in that they provide for a bumpy topography that can effectively scrub and massage the fabric.

Fibers can be woven, nonwoven, hooked, or looped fibers, for example, and be provided for instance by a woven or nonwoven fibrous web being attached to the cap 10 in the desired location. An inexpensive and easily manufactured embodiment of cap 10 can be made by using fibers as the first surface irregularities 150.

Figure 6:
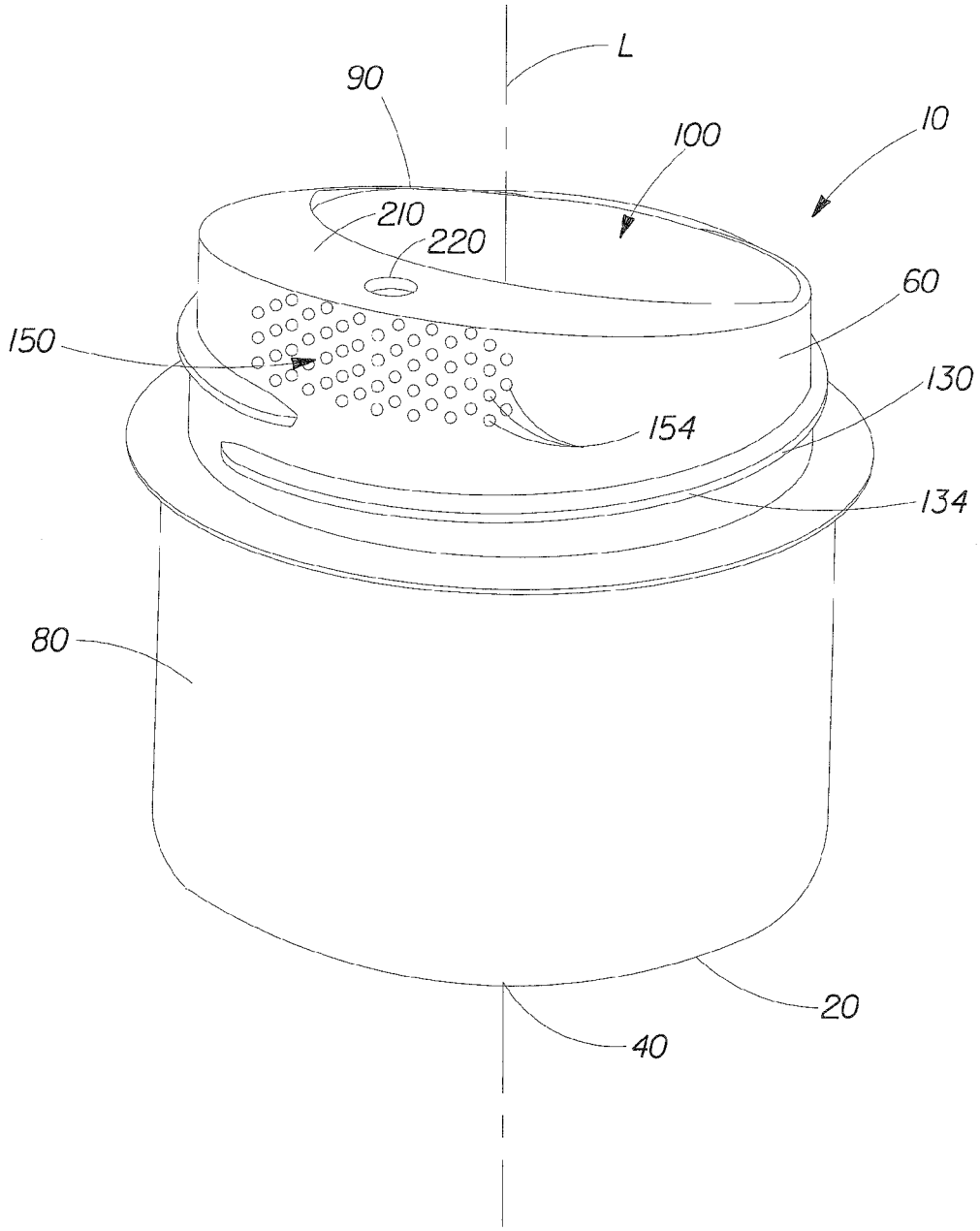
FIG. 6 is a schematic of a cap having a pouring ledge, aperture, and first surface irregularities.

A cap 10 providing for enhanced restrictive pouring of small volumes of detergent composition 300 is also contemplated. For instance, the cap 10 may be provided with a pouring ledge 210 having an aperture 220 there through extending from the vessel wall 60 or rim 90, an example of which is shown in FIG. 6. The aperture 220 can provide for a discrete and precise pour.

The aperture 220 can be generally aligned with the first surface irregularities 150. In such an embodiment, by generally aligned it is meant that the aperture 220 and first surface irregularities are at least within about 0.25π radians of one another about the longitudinal axis L.

As illustrated in FIG. 6, the pouring ledge 210 can extend from the vessel wall 60 or rim 90 back towards the longitudinal axis L. When the cap 10 is slightly tipped to initiate pouring a small volume of detergent composition 300 onto the stained fabric, the pouring ledge 210 can help the consumer limit the amount of detergent composition 300 applied to the stained fabric by allowing the detergent composition 300 to be dispensed from the cap 10 through the aperture 220. Once the proper amount of detergent composition 300 is applied to the stained fabric, the detergent composition 300 remaining in the cap 10 can be dosed to the washing machine by further tipping the cap 10 over the washing machine and allowing the detergent composition 300 to be completely poured from the cap 10. For added convenience, the aperture 220 can be generally aligned with the first surface irregularities 150 so that the user doses not have to reposition the cap 10 in her hand to initiate scrubbing of the stained fabric with the first surface irregularities 150.

Figure 7:
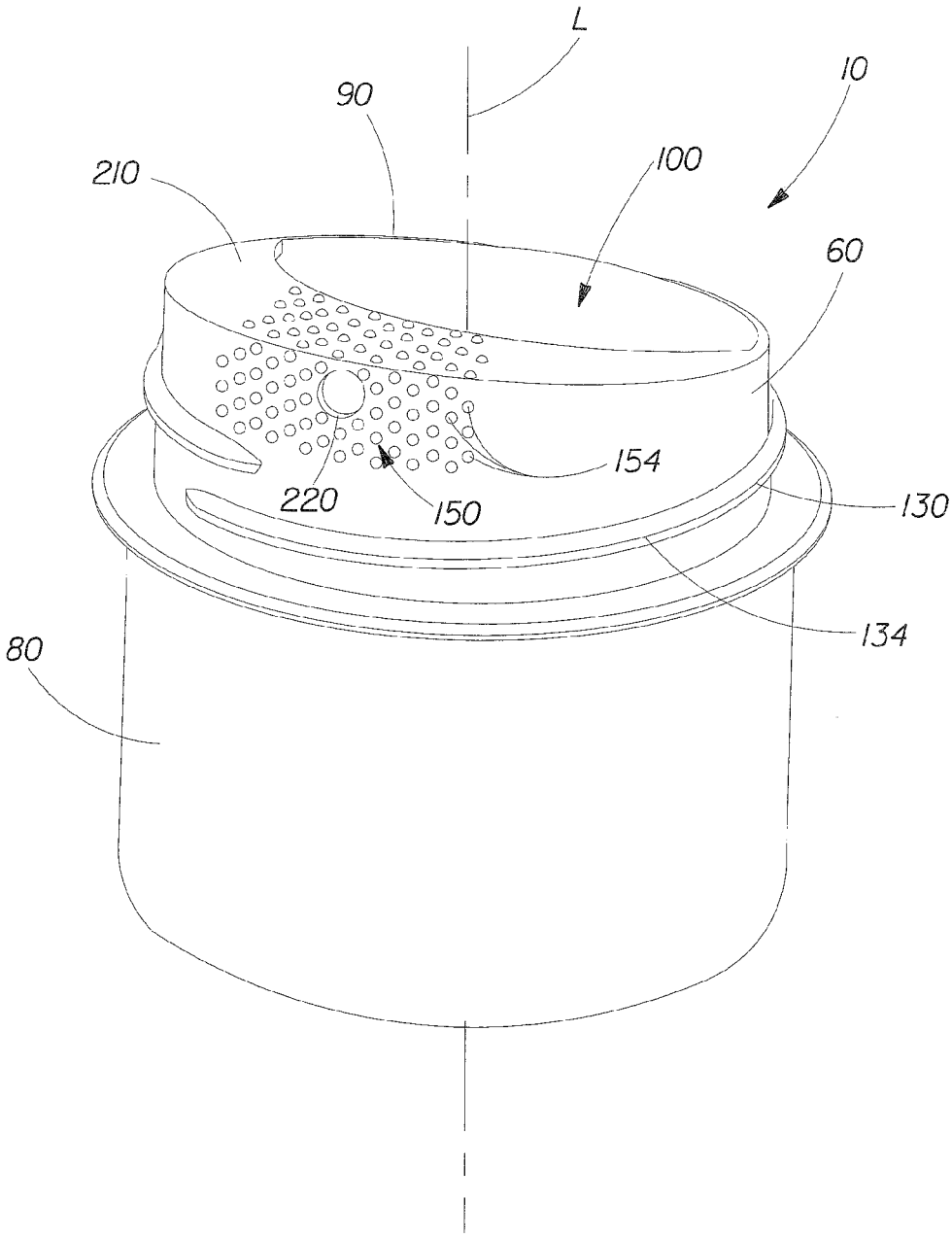
FIG. 7 is a schematic of a cap having a pouring ledge, aperture, and first surface irregularities.

In another alternative arrangement as illustrated in FIG. 7, the pouring ledge 210 can extend from the vessel wall 60 or rim 90 and an aperture 220 is in the vessel wall 60 between the pouring ledge 210 and the base 20 and the aperture 220 is generally aligned with the first surface irregularities 150. In such an embodiment, by generally aligned it is meant that the aperture 220 and first surface irregularities 150 are at least within about 0.25π radians of one another about the longitudinal axis L.

The pouring ledge 210 can be sized, dimensioned, and arranged to provide for a restriction of flow of detergent composition 300 when a small pour of detergent composition 300 is being made by the consumer. A portion of the pouring ledge 210 can extend back from the vessel wall 60 or rim 90 towards the longitudinal axis L and be in a plane orthogonal to the longitudinal axis L. A portion of the pouring ledge 210 can extend back from the vessel wall 60 or rim 90 in a plane within about plus or minus 0.5π radians of being orthogonal to the longitudinal axis L. A portion of the pouring ledge 210 may further extend downwards in the pour volume 100 towards the base interior 30. Such a design might provide for improved control of the quantity of detergent composition 300 delivered to the stain during pre-treatment.

Figure 8:
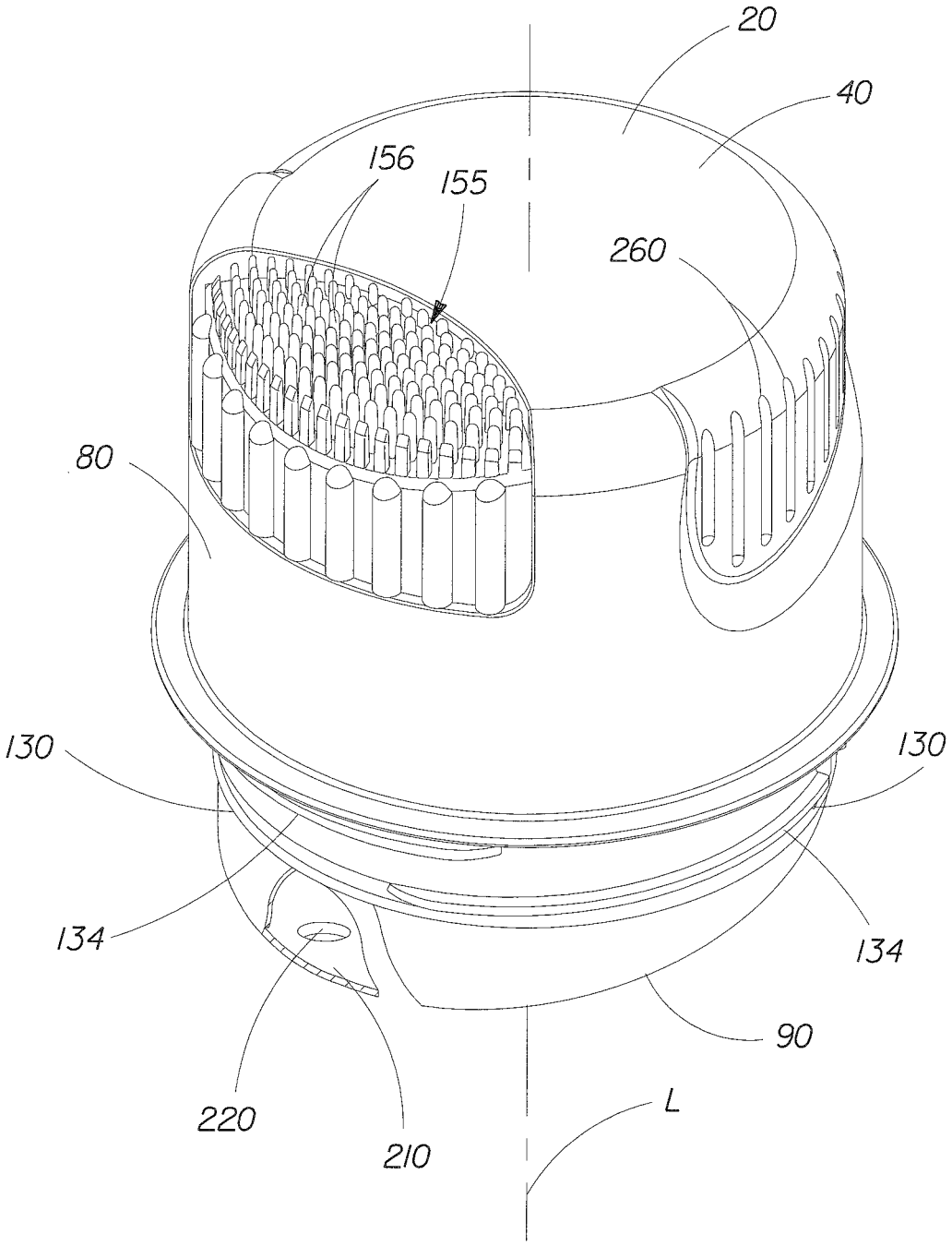
FIG. 8 is a schematic of a cap having second surface irregularities.

Embodiments in which the cap comprises a plurality of second surface irregularities 155 on the outside of the cap 10 such that the connecter 130 is between the rim 90 and the second surface irregularities 155 are also contemplated, as shown in FIG. 8. The cap 10 can have second surface irregularities 155 and not have first surface irregularities 150. The scrubbing surface of the cap can be provided on the outside of the cap such that the connecter 130 is between the rim 90 and the second surface irregularities 155 and possibly not be provided elsewhere on the cap. The cap 10 can comprise a plurality of second surface irregularities 155 at a location selected from the group consisting of on a portion of the base exterior 40, on a portion of the exterior surface 80, and combinations thereof.

The cap 10 can comprise a plurality of second surface irregularities 155 at a location selected from the group consisting of on said base exterior 40 with said second surface irregularities 155 being asymmetrically disposed about the longitudinal axis L, on the exterior surface 80 with the second surface irregularities 155 being asymmetrically disposed about the longitudinal axis L, on the base exterior 40 with the second surface irregularities 155 comprising bristles 156, on the exterior surface 80 with the second surface irregularities 155 comprising bristles 156, and combinations thereof. In such embodiments, the second surface irregularities 155 can be disposed such that the connector 130 is between the rim 90 and the second surface irregularities 155. Second surface irregularities 155 can be any of the structures described above with respect to first surface irregularities 150. The second surface irregularities 155 can be structures selected from the group consisting of rings 158, ribs 152, nubs 154, bristles 156, fibers, and combinations thereof.

By placing the second surface irregularities 155 as such, the second surface irregularities can be located such that after the consumer dispenses a small volume of detergent composition 300 to pre-treat a stain, the second surface irregularities 155 are located such the that user does not have to reposition the cap 10 in her hand or significantly move her hand to be able to position the second surface irregularities 155 in an appropriate position to be rubbed against the stain.

The second surface irregularities 155 can comprise a first material and another portion of the cap 10 next to the first material can comprise a second material, wherein the first material and the second material differ from one another by a property selected from the group consisting of modulus of elasticity, chemical composition, color, Shore A hardness, and combinations thereof. Such an arrangement can be provided in the same manner and for the same reasons as described above for a cap 10 in which the first surface irregularities 155 are formed from a different material than another portion of the cap 10.

Embodiments in which the second surface irregularities 155 are asymmetrically disposed about the longitudinal axis L can help the consumer identify what portion of the cap 10 is provided for scrubbing the stain during pre-treatment. By asymmetrically disposed, it is meant that such asymmetrically disposed second surface irregularities 155 are disposed such that the second surface irregularities 155 on the exterior surface 80 or base exterior 40 are not balanced about a single location, such as a point on the longitudinal axis L or other point. The cap can 10 can comprise a plurality of gripping irregularities 260 on the exterior surface 80 and/or base exterior 40 and the gripping irregularities 260 can be uniformly distributed about a location to provide structures that help the consumer grip the cap when removing the cap 10 from the container 110. The gripping irregularities 260 may be symmetrically distributed on the exterior surface 80 and/or base exterior 40 about a location so as to have one-fold symmetry, for example a fold passing through a point on the longitudinal axis L.

The second surface irregularities 155 can be comprised of a first material and the gripping irregularities 260 can be comprised of a second material, wherein the first material differs from the second material by a property selected from the group consisting of modulus of elasticity, chemical composition, color, Shore A hardness, and combinations thereof. Such an arrangement can help the user identify the portion of the cap 10 that is designed to be used as a scrubbing implement.

The cap 10 can be a cap 10 wherein a pouring ledge 210 having an aperture 220 there through extends from the vessel wall 60 or rim 90 and the aperture 220 is generally aligned with the second surface irregularities 155 or wherein a pouring ledge 210 extends from the vessel wall 60 or rim 90 and an aperture 220 is in the vessel wall 60 between the pouring ledge 210 and the base 20 and the aperture 220 is generally aligned with the second surface irregularities 155. An illustration of aspects of such an embodiment is shown in FIG. 8.

Figure 9:
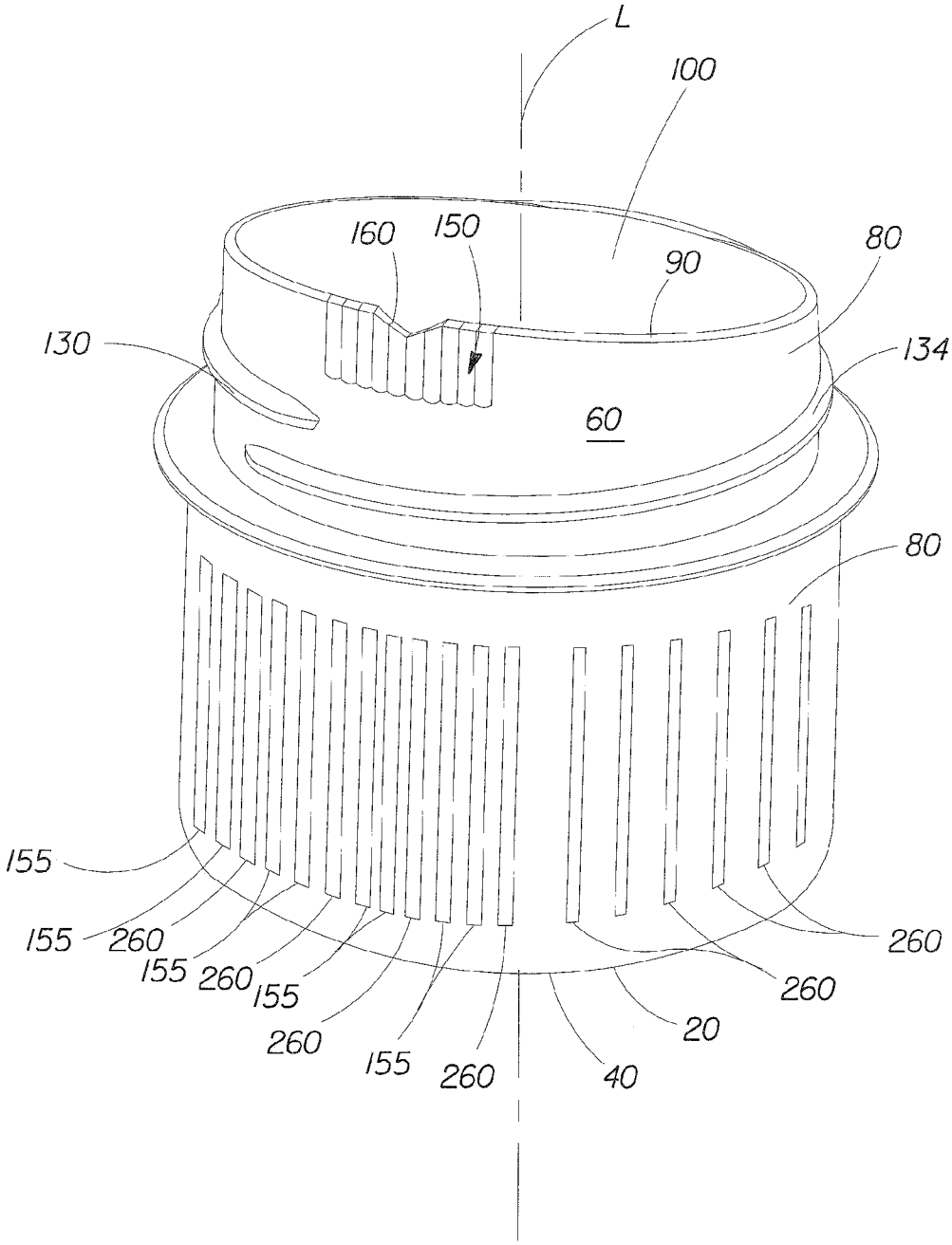
FIG. 9 is a schematic of a cap having second surface irregularities.

As shown in FIG. 9, the rim 90 can have a weir 160 and the weir 160 can be generally aligned with the second surface irregularities 155. In such an embodiment, by generally aligned it is meant that the weir 160 and second surface irregularities 155 are at least within about 0.25π radians of one another about the longitudinal axis L. In such an embodiment, as the user tips the cap 10 to deliver a small volume of detergent composition 300 to the stain, the second surface irregularities 155 will naturally be located proximal the stain and the user will be able to easily initiate the scrubbing motion without having to tip the cap 10 further or reposition the cap 10 in her hand.

An embodiment in which the second surface irregularities 155 are ribs 152 is shown in FIG. 9. As shown in FIG. 9, the ribs 152 are asymmetrically disposed about the longitudinal axis L in that the pattern of ribs 152 does not extend all the way around the exterior surface 80. The pattern of gripping irregularities 260 is uniformly distributed about the longitudinal axis L such that the pattern of gripping irregularities 260 extends all the way around the exterior surface 80. As shown in FIG. 9, the second surface irregularities 155 and the first surface irregularities 150, if present, can be generally aligned with one another. In such an embodiment, by generally aligned it is meant that the first surface irregularities 150 and second surface irregularities 155 are at least within about 0.25π radians of one another about the longitudinal axis L. Such an embodiment can provide for giving consumers a choice of which part of the cap they desire to use for scrubbing. Consumers may rather use the second surface irregularities 155 if there is some volume of detergent composition 300 left in the cap 10. Consumers might choose between first surface irregularities 150 and second surface irregularities 155 based on efficacy for different types of stains.

If the cap 10 has both first surface irregularities 150 and second surface irregularities 155, the second surface irregularities 155 can be substantially identical in physical structure to the first surface irregularities 150. In such an embodiment, by substantially identical it is meant that the first surface irregularities 150 and second surface irregularities 155 have the same geometric characteristics or differ, if at all, only in scale or dimension. For instance, if the second surface irregularities 155 are nubs 154 then the first surface irregularities can also be nubs 154. The nubs 154 in each location may have the same geometric characteristics or differ only in scale or dimension of the nubs 154. In one embodiment, the second surface irregularities 155 can be ribs 152 and the first surface irregularities 150 can also be ribs 152. Such embodiments might provide for designs in which the first surface irregularities 150 are obscured from view when the cap 10 is engaged with the container 110 when the container 110 is on display at a retailer. Since the second surface irregularities 155 are visible to the consumer in this condition, the second surface irregularities 155 can provide an indicator to the consumer of what the obscured first surface irregularities 150 look like without the consumer having to open the package. This can be important when the container 110 is on display at a retailer because consumers might desire to open the container 110 prior to purchase to see if the cap 10 is provided with the first surface irregularities 150. Embodiments in which the second surface irregularities 155 can be selected from the group consisting of rings 158, ribs 152, nubs 154, bristles 156, fibers, and combinations thereof, are contemplated.

For second surface irregularities 155 that are bristles 156, bristles 156 can be formed such that the bristles are generally aligned parallel to the longitudinal axis, as for instance shown in FIG. 8, or generally aligned orthogonal to the longitudinal axis L. In such an arrangement, when the second surface irregularities 155 are scrubbed against the stained fabric, the cap 10 is likely to be tilted. Thus, as the user scrubs with the cap, a combination of normal forces and shear forces can be delivered to the stained fabric and the bristles 156 may tend to bend thereby creating an effective brushing movement of the individual bristles 156.

The bristles 156, if present as second surface irregularities 155, can be set such that the bristles 156 are nested with the maximum radial extent of the exterior surface 80 of the cap 10 from the longitudinal axis L. Such an arrangement can protect the bristles 156 from damage during transport, storage, and use. For a similar benefit, the bristles 156 can be set such that the bristles 156 are nested within the maximum axial extent along the longitudinal axis L.

Figure 10:
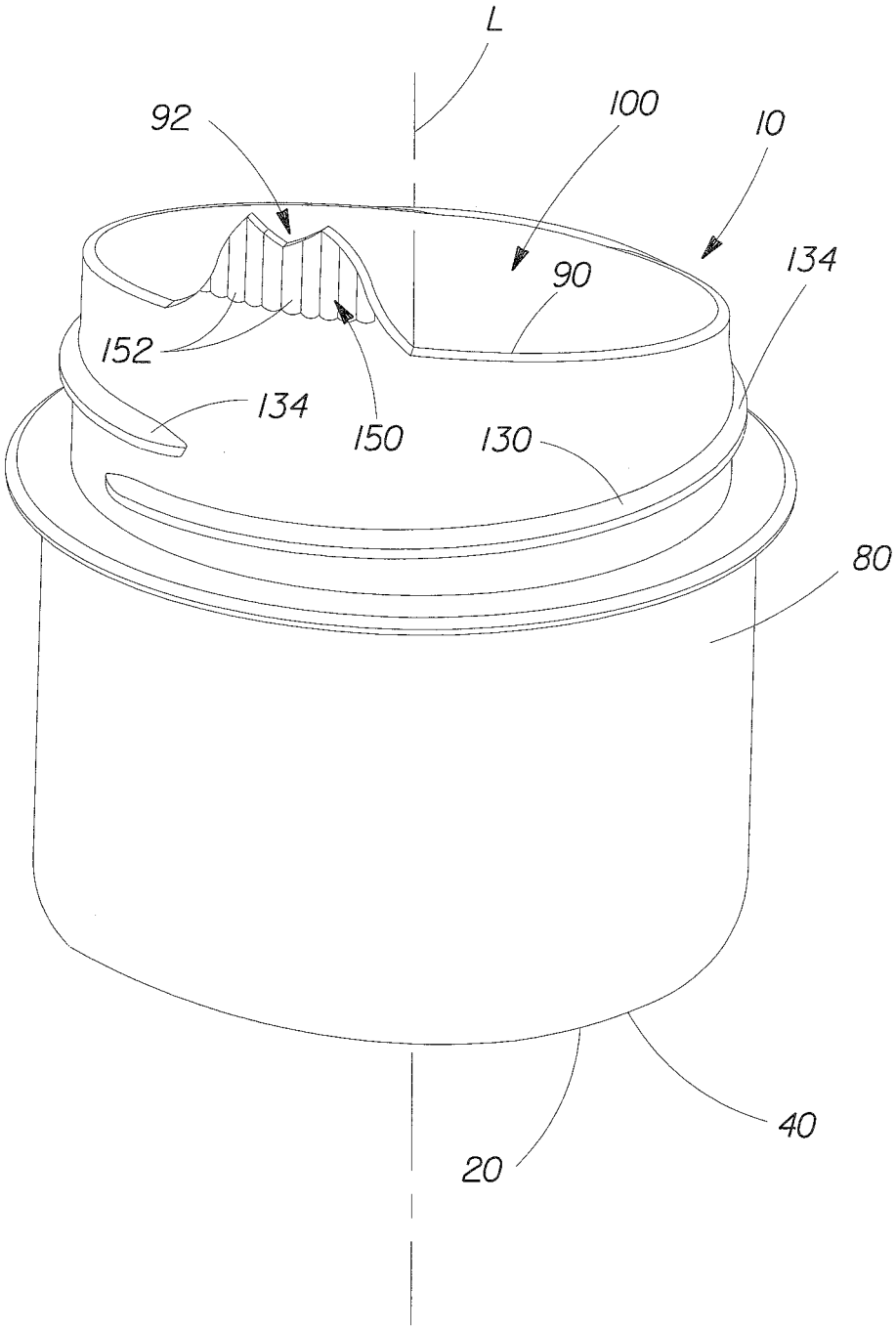
FIG. 10 is a schematic of a cap having a spout.

An example of a cap 10 in which the rim 90 has the shape of a spout 92 is illustrated in FIG. 10. A cap 10 in which the rim 90 has the shape of a spout 92 can be practical for providing for a precise pour of a small volume of detergent composition 300 to a stained fabric and to help keep a large volume of detergent composition 300 from being accidentally dispensed during pre-treatment of a stain. A variety of spout 92 geometries can be practical, particularly those geometries which tend to tightly channel liquid flow.

A plurality of first surface irregularities 150 can be provided at the tip of the spout 92. First surface irregularities 150 can be advantageously placed as such so that once the small volume of detergent composition 300 is poured onto the stain, the cap 10 is positioned in the user's hand such that the first surface irregularities 150 can be conveniently rubbed against the stain. Further, if the user only places a small volume of detergent composition 300 in the pour volume 100 and tips the cap 10 nearly completely over when she pre-treats the stain, the spout 92 can still be visible to the user and she will be able to see the first surface irregularities 150 and observe her scrubbing of the stain. Without a spout 92, the portion of the rim 90 located opposite of the side from which the detergent composition 300 is dispensed might obstruct her view of the first surface irregularities 150 and her scrubbing of the stain. Further, since the consumer may tend to pour from the cap 10 such that the flow emanates from a location on the rim 90 between her index finger and thumb as she rotates her wrist, the first surface irregularities 150 can be located such that these features might be conveniently and ergonomically located for the consumer to exploit these features. For instance, the cap 10 can comprise a plurality of first surface irregularities 150 at a location selected from the group consisting of on the rim 90, between the connecter 130 disposed on the cap 10 and the rim 90, and combinations thereof.

Figure 11:
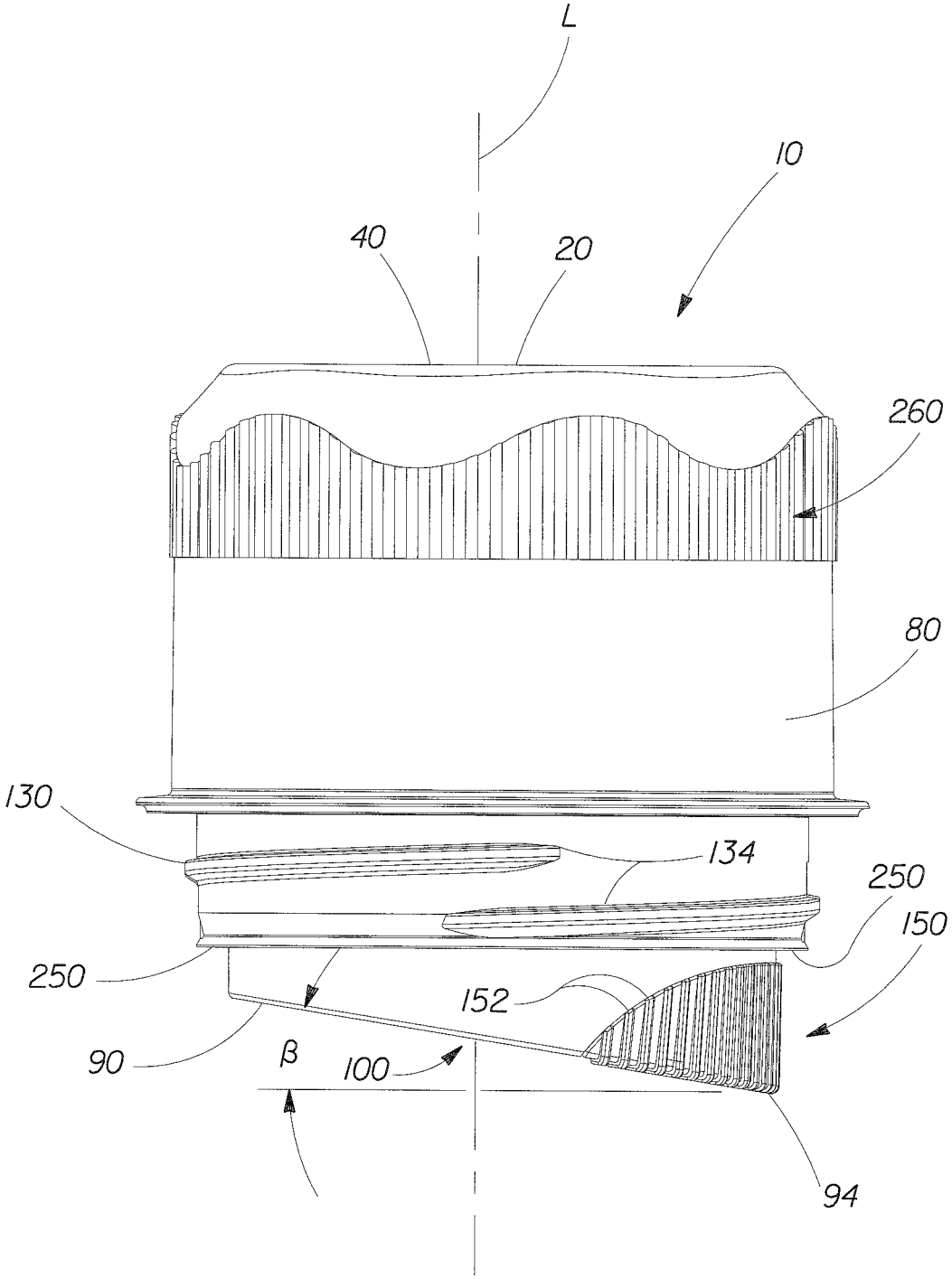
FIG. 11 is a schematic of a cap having a spout.

One example design for a practical spout 92 can be a cylindric section, as illustrated in FIG. 11. A spout 92 having the shape of a cylindric segment can be structurally stable so that an unacceptable amount of deformation of the rim 90 does not occur during scrubbing of the stain. Further, after filling the pour volume 100 of the cap 10 with detergent composition 300, the user may tend to try to keep the phreatic surface of the detergent composition 300 level with the ground. When the phreatic surface of the detergent composition 300 in the pour volume 100 is kept level, the profile view of the cap 10 will present an angled rim 90 to the viewer. The consumer expectation for dosing devices, such as caps or cups, might be that the rim 90 of the cap should be level with the ground, for instance as might be the case for caps that have a cylindrical pour volume 100. Thus, when applying the detergent composition 300 to pre-treat a stain, the consumer might naturally and intuitively attempt to level the rim 90 of the cap as she pours out the detergent composition 300 from the cap 10. A consumer may tend to pour from the cap 10 such that the flow emanates from a location between her index finger and thumb as she rotates her wrist. With these insights, designers might be able to have a significant influence on what portion of the rim 90 that a consumer will choose to pour from. By driving the consumer to pour from a certain portion of the rim 90, designers can coordinate the location of other features on the cap, for example first surface irregularities 150, second surface irregularities 155, aperture 220, pouring ledge 210, weir 160, and collector 250, such that these features might be conveniently and ergonomically located to allow the user to exploit these features without having to reposition the cap 10 in her hand.

In one example embodiment, the rim 90 can be parallel to a plane oriented at an angle β more than about five degrees out of plane with respect to the base exterior 40. In one example embodiment, the rim 90 can be parallel to a plane oriented at an angle β more than about ten degrees out of plane with respect to the base exterior 40. In one example embodiment, the rim 90 can be parallel to a plane oriented at an angle β more than about fifteen degrees out of plane with respect to the base exterior 40.

The rim 90 can have an apex 94, which is the highest portion of the rim 90 when the cap 10 positioned on a flat surface such that detergent composition 300 can be poured into the pour volume 100. The rim 90 can be provided with a weir 160. In one embodiment, the rim 90 can be parallel to a plane oriented at an angle β more than about five degrees out of plane with respect to the base exterior 40 and the rim can have an apex 94 relative to the base exterior 40 and the cap 10 can comprise a plurality of first surface irregularities 150 on the rim 90.

Figure 12:
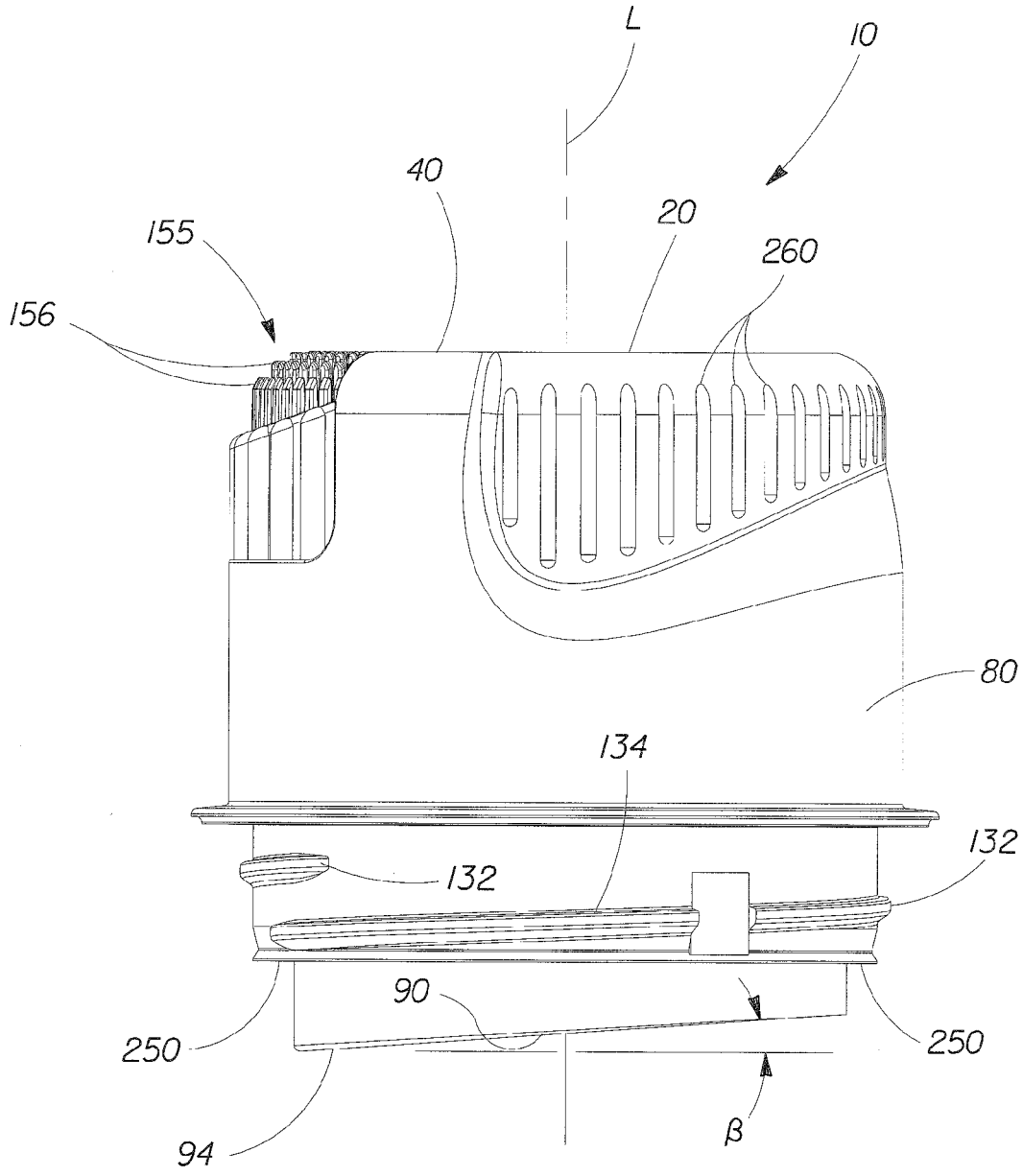
FIG. 12 is a schematic of a cap having second surface irregularities and a spout.

A cap 10 having a spout 92 can have a plurality of second surface irregularities 155 on a portion of the base exterior 40 or a portion of the exterior surface 80, an example of which is shown in FIG. 12. In one example embodiment, the apex 94 and the second surface irregularities 155 are generally aligned with one another. In such an embodiment, by generally aligned, it is meant that the apex 94 and the second surface irregularities 155 are at least within about 0.25π radians of one another about the longitudinal axis L. In one embodiment, the rim 90 can have a weir 160 at the apex 94 and the apex 94 and the second surface irregularities 155 can be generally aligned with one another. In such embodiments, by generally aligned, it is meant that the apex 94 and the second surface irregularities 155 are at least within about 0.25π radians of one another about the longitudinal axis L. In embodiments having such second surface irregularities 155, by coordinating the location of the second surface irregularities 155 with the apex 94, and weir 160 if present, when the consumer finishes pouring the detergent composition 300 to pre-treat the stain, the second surface irregularities 155 can be in the proper position for the consumer to scrub the stain with the second surface irregularities 155 without her having to reposition the cap 10 in her hand. After pouring, she will likely be holding the cap 10 in an upright position with the second surface irregularities 155 located proximal to the stained fabric.

Figure 13:
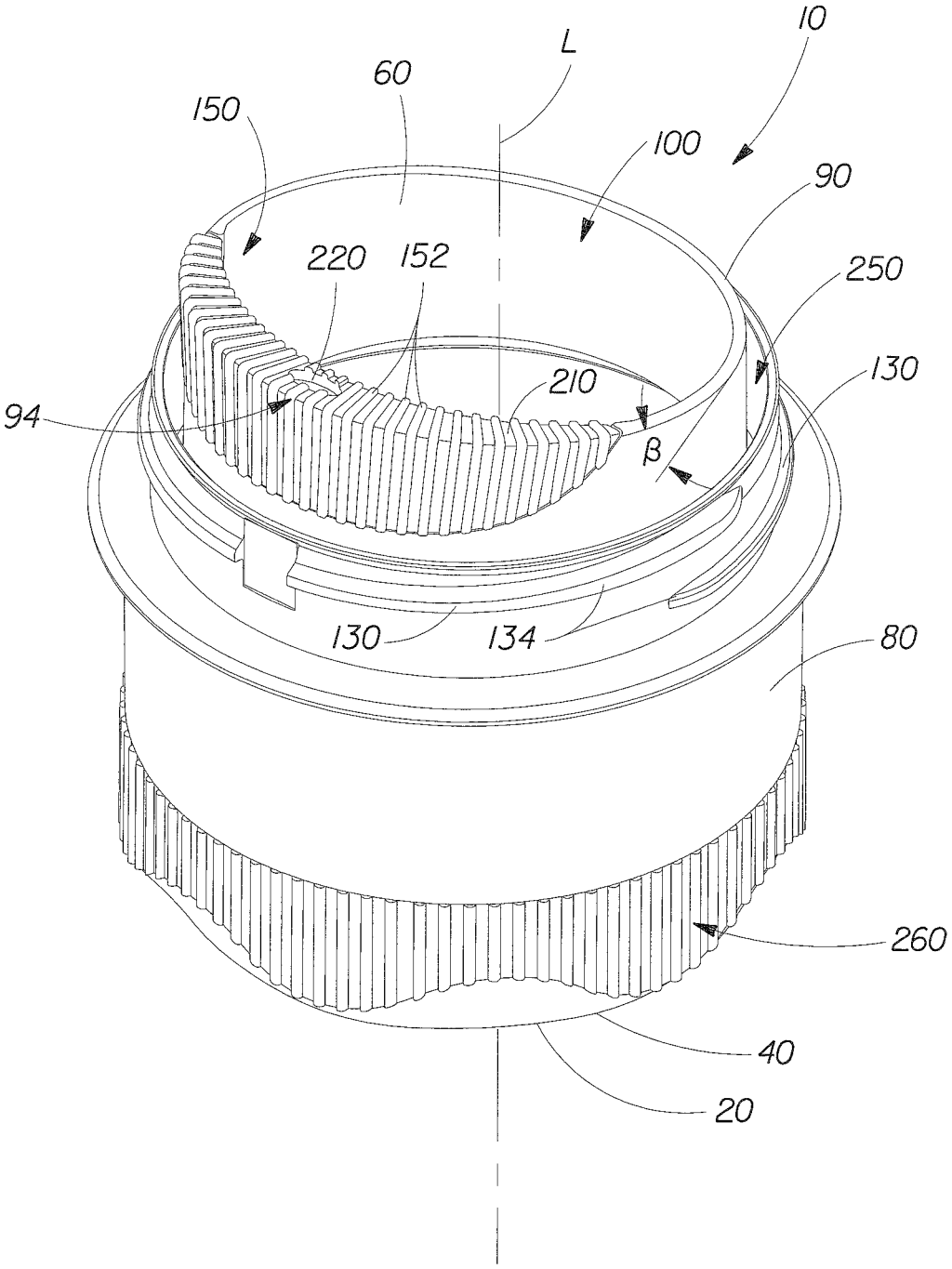
FIG. 13 is a schematic of a cap having first surface irregularities, a pouring ledge, an aperture, and an apex.

An example embodiment in which a pouring ledge 210 having an aperture 220 there through extends from the rim 90, the rim 90 having an apex 94 relative to the base exterior 40 and the aperture 220 is generally aligned with the apex 94 is shown in FIG. 13. As disclosed above, the pouring ledge 210 can extend from, for example, the vessel wall 60 or rim 90. Further, as disclosed above, the aperture 220 can be in the vessel wall 60 between the pouring ledge 210 and the base 20, the aperture 220 being closer to the pouring ledge 210 than the base 20. In these embodiments, by generally aligned, it is meant that the aperture 220 and the apex 94 are at least within about 0.25π radians of one another about the longitudinal axis L. Various combinations of these features can provide the desired benefit and can be described as a cap 10 wherein a pouring ledge 210 having an aperture 220 there through extends from the vessel wall 60 or rim 90 and the rim 90 has an apex 94 relative to the base exterior 40 and the aperture 220 is generally aligned with the apex 94 or, in an another embodiment, wherein a pouring ledge 210 extends from the vessel wall 60 or rim 90 and an aperture 220 is in the vessel wall 60 between the pouring ledge 210 and the base 20 and the aperture 220 is closer to the pouring ledge 210 than the base 20.

A cap 10 having various combinations of the features disclosed herein can provide an effective stain pre-treatment device. A cap 10 can be provided with first surface irregularities 150 at any of the locations or combinations of locations described above. A cap 10 can be provided with second surface irregularities 155 at any of the locations or combinations of locations described above. A cap 10 can be provided with first surface irregularities 150 and second surface irregularities 155, each of which are located at the locations or combinations of locations for second surface irregularities 155 described above. Various embodiments can be provided with a pouring spout 92 as described above to provide for more precise pouring. Such pouring spout 92 can be a cylindric section. Each of the embodiments contemplated herein can be provided with a pouring ledge 210 having an aperture 220 there through, as described above. Each of the embodiments contemplated herein can be provided with a collector 250. Embodiments contemplated herein can be provided with a weir 160 in the rim 90 to provide for precise pouring. The features of the cap 10 can be located relative to one another as described for the embodiments above.

A cap 10 may be used in a method of pre-treating a clothing article having a stained portion. The method can comprise the steps of removing a cap 10 from a container containing a detergent; pouring or dispensing a volume of the detergent composition 300 from the container 110 into the cap 10; applying at least a portion of the volume of the detergent composition 300 to a stained portion of the stained clothing article; scrubbing the stained portion with a portion of the cap 10; reengaging the cap 10 with the container 110 containing the detergent composition 300. The step of scrubbing the stained portion with a portion of the cap 10 can be performed with a portion of the cap 10 selected from the group consisting of the rim 90 of the cap 10, a portion of the cap 10 between the rim 90 and the connector 130, the exterior surface 80, the base exterior 40 of the cap 10, and combinations thereof. The cap 10 used in the method can be any of the various embodiments and combinations of embodiments of the cap 10 contemplated herein. The cap 10 can be removed from a container 110 by unscrewing the cap 10 to disengage threads 134 on the cap 10 from corresponding threads 134 located on the container 110. The cap 10 can be reengaged with the container 110 by screwing the cap 10 to engage threads 134 on the cap 10 with threads 134 located on the container 110. The cap 10 can have a spout 92. The spout 92 can be a cylindric section. The volume detergent composition 300 poured into the cap 10 can be a unit dose of the detergent composition 300. The method can comprise a step of placing the cap 10 in the drum of a washing machine. In such an approach, detergent composition 300 remaining in the cap 10 after pre-treatment of a stain can be delivered to the wash.

The color of the first material and second material are measured by the reflectance spectrophotometer according to the colors L*, a*, and b* values.

The color difference is calculated using the L*, a*, and b* values by the formula $\Delta E=[(L^*_X-L^*_Y)^2+(a^*_X-a^*_Y)^2+(b^*_X-b^*_Y)^2]^{1/2}$. Herein, the 'X' inthe equation represents the first material and 'Y' represents the second material, X and Y cannot be the same two points of measurement at the same time. For any particular comparison of the difference in color, the location of X≠ the location of Y.

Reflectance color is measured using the Hunter Lab LabScan XE reflectance spectrophotometer obtained from Hunter Associates Laboratory of Reston, Va. A cap 10 is tested at an ambient temperature between 65° F. and 75° F. and a relative humidity between 50% and 80%.

The spectrophotometer is set to the CIELab color scale and with a D65 illumination. The Observer is set at 10° and the Mode is set at 45/0°. Area View is set to 0.125" and Port Size is set to 0.20". The spectrophotometer is calibrated prior to sample analysis utilizing the black glass and white reference tiles supplied from the vendor with the instrument. Calibration is done according to the manufacturer's instructions as set forth in LabScan XE User's Manual, Manual Version 1.1, August 2001, A60-1010-862. If cleaning is required of the reference tiles or samples, only tissues that do not contain embossing, lotion, or brighteners should be used (e.g., PUFFS tissue). Any sample point on the cap containing the color to be analyzed can be selected.

The cap 10 is placed over the sample port of the spectrophotometer with a white clamp disk placed behind the cap 10.

The cap 10 is removed and repositioned so that a minimum of six readings of color of the cap 10 are conducted. If possible (e.g., the size of the imparted color on the element in question does not limit the ability to have six discretely different, non-overlapping sample points), each of the readings is to be performed at a substantially different region on the externally visible surface so that no two sample points overlap. If the size of the portion of the cap comprising the first material or second material requires overlapping of sample points, only six samples should be taken with the sample points selected to minimize overlap between any two sample points. The readings are averaged to yield the reported L*, a*, and b* values for a specified color on an externally visible surface of an element.

The first material and second material are considered to have different colors if ΔE is greater than about 1.

All percentages and ratios used herein are by weight of the total composition and all measurements made are at 25° C., unless otherwise designated. An angular degree is a planar unit of angular measure equal in magnitude to 1/360 of a complete revolution.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited are, in relevant part, incorporated herein by reference; the citation of any document is not to be construed as an admission that it is prior art with respect to the present invention.

What is claimed is:

1. A cap for dispensing a detergent composition, said cap comprising:

a base having a base interior and a base exterior opposing said base interior, said base interior having a periphery; and a vessel wall having an interior surface and an exterior surface opposing said interior surface, said vessel wall extending from said periphery to a rim, said interior surface and said base interior defining a pour volume, said base interior forming a closed end of said pour volume:

wherein said cap is sealingly engaged to a container containing a detergent composition by a connector disposed on said cap and a corresponding receiver disposed on an opening of said container;

wherein said cap further comprises a plurality of first surface irregularities at a location selected from the group consisting of on said rim, on said exterior surface between said connector disposed on said cap and said rim, and combinations thereof;

wherein said pour volume is sized and dimensioned to provide for a unit dose of said detergent composition;

wherein said rim has a weir; or wherein a pouring ledge having an aperture there through extends from said vessel wall or rim and said aperture is generally aligned with said first surface irregularities; or wherein a pouring ledge extends from said vessel wall or rim and an aperture is in said vessel wall between said pouring ledge and said base and said aperture is generally aligned with said first surface irregularities; and wherein said cap comprises a plurality of second surface irregularities on a locally distinct portion of said base exterior, said second surface irregularities being substantially identical in physical structure to said first surface irregularities.

2. The cap of claim 1, wherein said interior surface of said vessel wall is defined by a surface of revolution.

3. The cap of claim 1, wherein said rim has a weir generally aligned with said first surface irregularities.

4. The cap of claim 1, wherein said first surface irregularities are structures selected from the group consisting of rings, ribs, nubs, bristles, fibers, and combinations thereof.

5. The cap of claim 1, wherein said first surface irregularities comprise a first material and another portion of said cap next to said first material comprises a second material, wherein said first material and said second material differ from one another in chemical composition.

6. The cap of claim 1, wherein said first surface irregularities comprise a first material and another portion of said cap next to said first material comprises a second material, wherein said first material and said second material are measured by a Hunter Reflectance Meter test according to the colors L*, a*, and b*, the L*, a*, and b*, wherein said first material has a color difference, the color difference being calculated using the L*, a*, and b* values by the formula $\Delta E=[(L^*_X-L^*_Y)^2+(a^*_X-a^*_Y)^2+(b^*_X-b^{*Y})^2]^{1/2}$, wherein said $\Delta E$ between said first material and said second material is at least about 1.

7. The cap of claim 1, wherein said second surface irregularities are structures selected from the group consisting of rings, ribs, nubs, bristles, fibers, and combinations thereof.

8. The cap of claim 1, wherein said cap has a longitudinal axis about which said vessel wall extends, wherein said second surface irregularities are asymmetrically disposed about said longitudinal axis.

9. The cap of claim 8, wherein said second surface irregularities are structures selected from the group consisting of rings, ribs, nubs, bristles, fibers, and combinations thereof.

10. The cap of claim 1, wherein said second surface irregularities and said first surface irregularities are generally aligned with one another.

11. The cap of claim 1, wherein a collector at least partially surrounds said exterior surface of said vessel wall.

12. The cap of claim 1, wherein said first surface irregularities are on said rim, or within 5 mm of said rim, or on said rim and between said connector and said rim.

13. The cap of claim 1, wherein said connector is threads and said receiver is corresponding threads.

* * * * *